United States Patent [19]

Ward

[11] Patent Number: 4,995,243

[45] Date of Patent: Feb. 26, 1991

[54] DROP-IN REFRIGERATION UNIT

[75] Inventor: Allan Ward, San Souchi, Australia

[73] Assignee: F Muller Pty Limited, Kingsgrove, Australia

[21] Appl. No.: 299,760

[22] Filed: Jan. 23, 1989

[30] Foreign Application Priority Data

Jan. 28, 1988 [AU] Australia ..... PI6466

[51] Int. Cl.[5] ..... F25D 19/02

[52] U.S. Cl. ..... 62/298; 62/450; 62/DIG. 16

[58] Field of Search ..... 62/298, 448, 449, 450, 62/263, DIG. 16; 165/53

[56] References Cited

U.S. PATENT DOCUMENTS

| | | | |
|---|---|---|---|
| 2,094,542 | 9/1937 | Kuhnel | 62/449 |
| 2,203,439 | 6/1940 | Oliver | 62/448 X |
| 2,247,904 | 7/1941 | Brace | 62/448 X |
| 2,363,839 | 11/1944 | Demuth | 62/DIG. 16 |
| 2,475,841 | 7/1949 | Jones | 62/450 X |
| 2,737,787 | 3/1956 | Kritzer | 62/448 X |
| 2,756,569 | 7/1956 | Kritzer | 62/448 X |
| 2,896,428 | 7/1959 | Paton | 62/DIG. 16 |
| 4,507,940 | 4/1985 | Sato et al. | 62/298 X |

*Primary Examiner*—William E. Tapolcai
*Attorney, Agent, or Firm*—Ladas & Parry

[57] ABSTRACT

A refrigeration unit composed of a drop-in package to be accommodated within an aperture in the top of a cabinet, and comprising a plug insertable neatly into the aperture and mounting refrigeration components on top and an evaporator together with an air impeller in an underside compartment, abutment means on the plug to limit intrusion of the plug to a position substantially flush with the ceiling of the cabinet, and air ducts directing air flow from the air impeller in a path adjacent the ceiling due to a sweeping curvature of a wall of each air duct which influences the path of air flow in compliance with the "Coanda" effect.

6 Claims, 2 Drawing Sheets

DROP-IN REFRIGERATION UNIT

This invention relates to self-contained refrigeration unit packages of the kind supplied for installation upon refrigeration cabinets.

BACKGROUND ART

In the production of both walk-in and reach-in commercial refrigerators it is common practice to construct the cabinets with a roof aperture and to utilise drop-in refrigeration units. This practice eliminates the need for cabinet makers to employ costly specialised labour for the installation of individual refrigeration components. It is customary with such drop-in units to include a temperature insulating plug for positioning within the cabinet aperture and which mounts the compressor and condenser above the plug and the evaporator below. To allow for mounting of the evaporator and to achieve a good air circulatory pattern within the cabinet the entire unit protrudes somewhat into the cabinet with consequent loss of storage space.

DISCLOSURE OF INVENTION

It is the principal object of the invention to provide a self contained drop-in refrigeration unit which minimises the loss of storage space when installed upon a cabinet.

In accordance with the invention there is provided a drop-in package refrigeration unit for installation within an aperture in the roof of a refrigerator cabinet, said refrigeration unit comprising a heat insulating plug closing said aperture when said unit is installed, a depending peripheral skirt integral with said plug and defining a compartment at the underside of the plug, abutment means on said plug engageable with the roof of said cabinet to ensure that said skirt does not intrude substantially into said cabinet, refrigeration components mounted upon the top of the plug, a refrigeration evaporator positioned within said compartment, an air impeller within said compartment operating to create air flow over said evaporator, and air ducting defined by said skirt contoured to direct said air flow from the evaporator in a path adjacent the ceiling within said cabinet.

BRIEF DESCRIPTION OF DRAWINGS

The invention will be described in more detail with reference to the accompanying drawings, in which.

BEST MODE OF CARRYING OUT THE INVENTION

Figure 1:
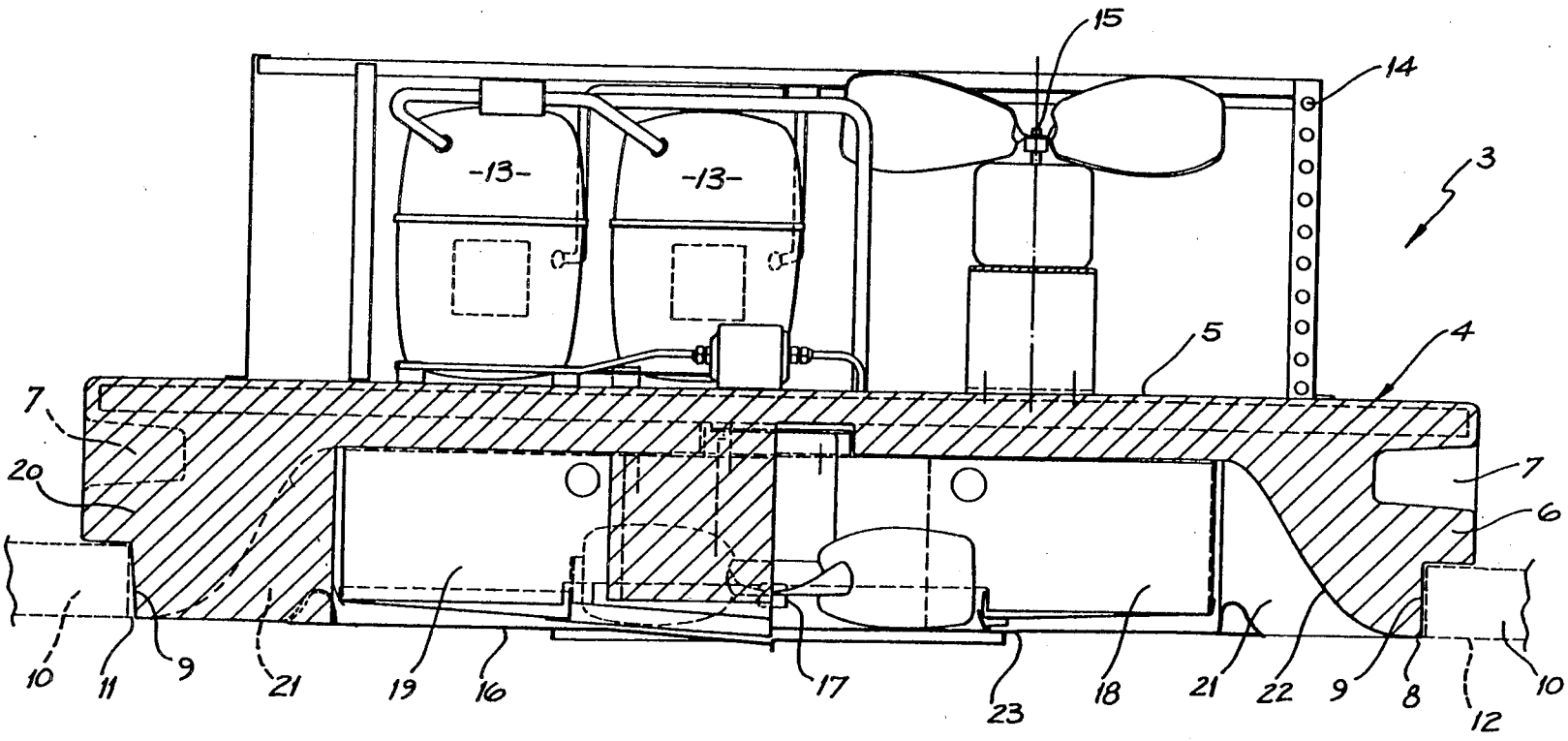
FIG. 1 shows in side elevation, and part section, a drop-in package refrigeration unit according to this invention; and, FIG. 2 is an end elevation, in part section, thereof.
Figure 2:
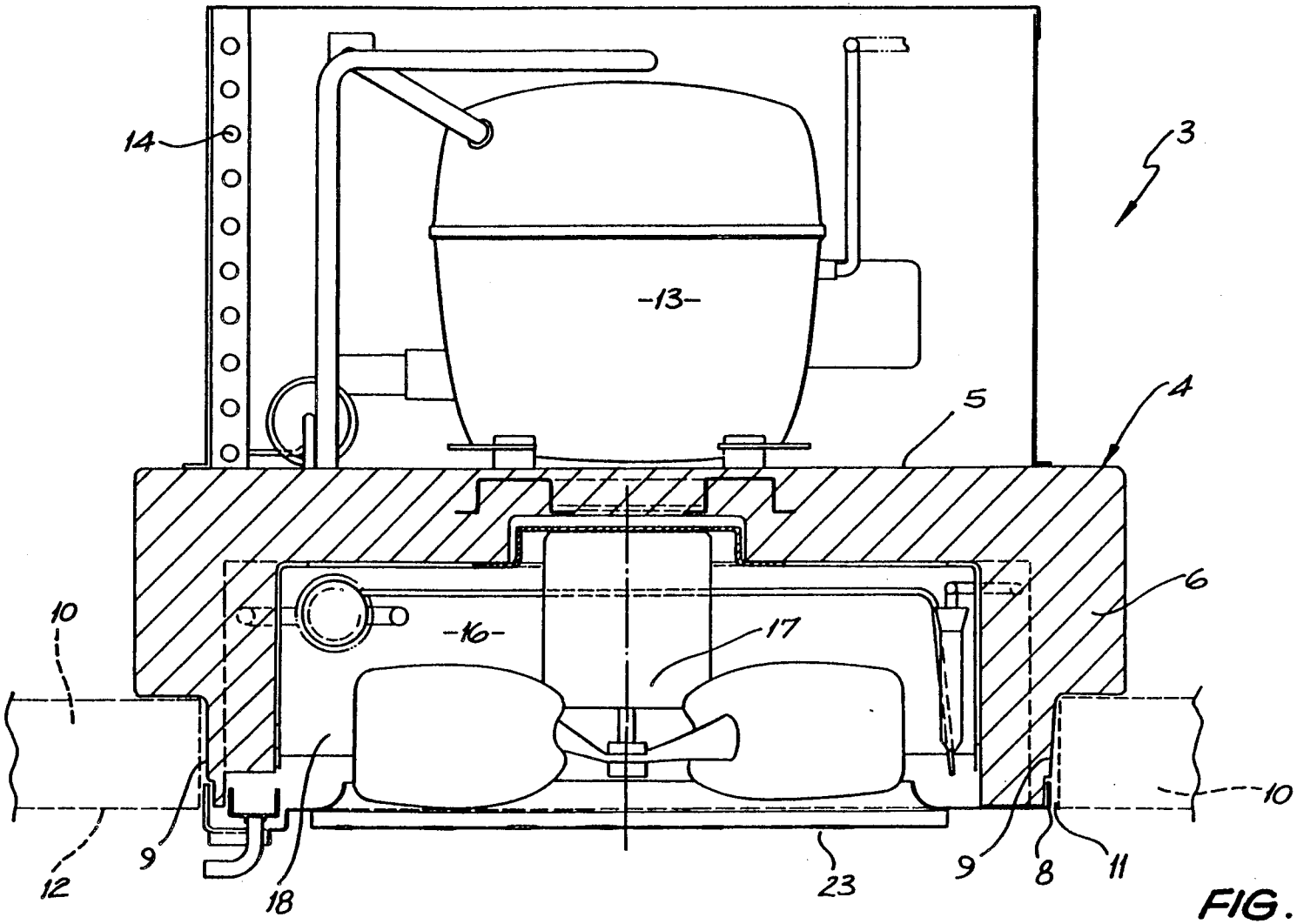

With reference to the drawings it will be seen that the drop-in refrigeration unit 3 consists of various refrigeration components mounted both above and below a plug 4. The plug 4 is constructed from any suitable heat insulating material and includes a platform 5, of rectangular shape, with an integral depending, peripheral skirt 6. Hand slots 7 are provided in the outer wall of the skirt 6 to facilitate carrying of the entire unit 3. The lower marginal edge 8 of the skirt 6 is provided with an outside, peripheral rebate 9 to enable the plug 4 to be seated upon the marginal edge portion of a cabinet 10 surrounding an aperture 11 in the top thereof. It will be noted that the lower end 8 of the skirt 6 lies substantially flush with the ceiling 12 of the cabinet 10.

Sealed refrigeration compressors 13, condenser 14, fan 15, and other ancillary equipment are fixedly mounted upon the top surface of the platform 5 of the plug 4. It will be noted that the skirt 6 defines a compartment 16 at the underside of the plug 4 and fixed therein is an air impeller 17 and spaced confronting evaporators 18 and 19. At the opposite ends 20 of the plug 4 open-sided ducts 21 are defined by the skirt 6 upon the inner face of its walls with one end of each of the ducts 21 positioned adjacent a respective one of the evaporators 18 and 19. A wall 22 of each duct 21 is provided with a sweeping contour inwardly curved along the length of the duct from the underside of the platform 5 and tapering away towards the edge of the rebate 9 at the lower end 8 of the skirt 6. That is to say that the wall 22 is inwardly bulging. The contour of the wall 22 is such that air flow created by operation of the fan 17 passes over the respective evaporator 18 or 19 and is directed by the curvature of the wall 22 to a path whereby it travels adjacent the ceiling 12 of the cabinet 10. This flow path is achieved due to the phenomenon of air flow adherence to a curved surface which is known as the "Coanda" effect. A suitable vented cover 23 encloses the compartment 16 and also forms an outer wall for each of the ducts 21.

The provision and construction of the ducts 21 in the skirt 6 enables the establishment of a good circulatory cooling air flow and air distribution within the cabinet 10, and consequently avoids the need for protrusion of the plug 6 into the cabinet 10 for the positioning of conventional air flow vents in order to obtain an acceptable pattern of air flow within the cabinet 10. As a result more space is provided for storage of goods within the cabinet 10.

Whereas as a preferred embodiment has been described in the foregoing passages it should be understood that other forms, modifications and refinements are feasible within the scope of this invention.

What I claim is:

1. A drop-in package refrigeration unit for installation within an aperture in the roof of a refrigerator cabinet, said refrigeration unit comprising a heat insulating plug closing said aperture when said unit is installed, a depending peripheral skirt integral with said plug and defining a compartment at the underside of the plug, abutment means on said plug engageable with the roof of said cabinet to ensure that said skirt does not intrude substantially into said cabinet, refrigeration components mounted upon the top of the plug, a refrigeration evaporator positioned within said compartment, an air impeller within said compartment operating to create air flow over said evaporator, and air ducting defined by said skirt which includes a wall inwardly curved along its length and tapering towards a lower end of said skirt to direct said air flow from the evaporator in a path adjacent the ceiling within said cabinet.

2. A refrigeration unit according to claim 1, wherein the curvature of said wall is such that the path of the air flow substantially adheres to said curvature in compliance with the "Coanda" effect.

3. A refrigeration unit according to claim 1, wherein the spacing of said abutment means from the lower end of said skirt is such that said lower end of said skirt is flush with the cabinet ceiling when said refrigeration unit is installed on said cabinet.

4. A refrigeration unit according to claim 3, wherein said abutment means is provided by an outside peripheral rebate on said skirt.

5. A refrigeration unit according to claim 1, wherein said compartment is provided by an underside recess in said plug, and a vented cover encloses said compartment and forms an outer wall for said air ducting.

6. A refrigeration unit according to claim 1, wherein said air ducting comprises air ducts formed by the inner face of the skirt wall and provided at opposite parts of said plug.

* * * * *